US006630782B1

(12) United States Patent
Nakatani et al.

(10) Patent No.: US 6,630,782 B1
(45) Date of Patent: Oct. 7, 2003

(54) IMAGE DISPLAY APPARATUS HAVING ELECTRODES COMPRISED OF A FRAME AND WIRES

(75) Inventors: Toshifumi Nakatani, Osaka (JP); Takatsugu Kurata, Osaka (JP); Kanji Imai, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/198,162

(22) Filed: Nov. 23, 1998

(30) Foreign Application Priority Data

Dec. 1, 1997 (JP) ..... 9-330633

(51) Int. Cl.[7] ..... H01J 1/62

(52) U.S. Cl. ..... 313/496; 313/495; 313/422

(58) Field of Search ..... 313/309, 311, 313/336, 351, 495, 496, 497, 422, 238, 260–61, 271, 292, 284–85, 249

(56) References Cited

U.S. PATENT DOCUMENTS

| | | | | |
|---|---|---|---|---|
| 3,600,778 A | | 8/1971 | Martin | |
| 3,875,442 A | * | 4/1975 | Wasa et al. | 313/495 |
| 4,145,633 A | | 3/1979 | Peters | |
| 4,223,244 A | | 9/1980 | Kishino et al. | |
| 4,368,404 A | | 1/1983 | Daisyaku | |
| 4,404,493 A | | 9/1983 | Nonomura et al. | |
| 4,672,272 A | | 6/1987 | Littwin | |
| 4,891,552 A | | 1/1990 | Moriyama et al. | |
| 4,900,981 A | | 2/1990 | Yamazaki | |
| 4,908,539 A | | 3/1990 | Meyer | |
| 4,982,134 A | | 1/1991 | Aono et al. | |
| 5,083,058 A | | 1/1992 | Nonomura et al. | |
| 5,504,387 A | | 4/1996 | Hamagishi | |
| 5,565,742 A | * | 10/1996 | Shichao et al. | 313/257 |
| 5,652,083 A | | 7/1997 | Kumar et al. | |
| 5,859,508 A | * | 1/1999 | Ge et al. | 313/422 |
| 5,949,395 A | * | 9/1999 | Stevens et al. | 313/496 |

FOREIGN PATENT DOCUMENTS

| | | |
|---|---|---|
| EP | 0 172 089 | 2/1986 |
| EP | 0 312 007 | 4/1989 |
| EP | 0 316 871 | 5/1989 |
| EP | 0 404 022 | 12/1990 |
| EP | 0 572 777 | 12/1993 |
| EP | 0 614 209 | 9/1994 |
| EP | 0 616 354 | 9/1994 |
| EP | 0 628 982 | 12/1994 |
| EP | 0 739 029 | 10/1996 |
| EP | 0 896 358 | 2/1999 |
| GB | 932212 | 7/1963 |
| JP | 53-38260 | 4/1978 |
| JP | 53-74357 | 7/1978 |
| JP | 60-172152 | 9/1985 |
| JP | 62-29046 | 2/1987 |
| JP | 2-61946 | 3/1990 |
| JP | 2-288052 | 11/1990 |
| JP | 3-67444 | 3/1991 |
| JP | 3-149728 | 6/1991 |
| JP | 3-192639 | 8/1991 |
| JP | 4-249048 | 9/1992 |
| JP | 6-342635 | 12/1994 |
| JP | 7-326306 | 12/1995 |
| JP | 8-236044 | 9/1996 |
| WO | 96/30926 | 10/1996 |
| WO | 97/15912 | 5/1997 |

* cited by examiner

*Primary Examiner*—Vip Patel
*Assistant Examiner*—Joseph Williams
(74) *Attorney, Agent, or Firm*—Merchant & Gould, P.C.

(57) ABSTRACT

An image display apparatus comprises, in a vacuum container formed by a rear container and a front glass container, a fluorescent layer, an electron emission source, electrodes to control electron beams emitted from the electron emission source. The electrodes are formed by stringing wires on frames made of a resilient material, and the frames on which the wires are strung have respectively pairs of opposing sides that are flat plates formed on the same surface. The electrodes that are free from waviness or warping have high flatness, control the focusing and deflection of the electron beams appropriately, and prevent deviation of the landing positions of the electron beams and errors including error irradiation. Such an image display apparatus can provide excellent images and high resolution.

25 Claims, 9 Drawing Sheets

IMAGE DISPLAY APPARATUS HAVING ELECTRODES COMPRISED OF A FRAME AND WIRES

FIELD OF THE INVENTION

The present invention relates to an image display apparatus, and more particularly relates to a thin image display apparatus used for a video camera and the like.

BACKGROUND OF THE INVENTION

Conventionally, cathode ray tubes have been used mainly as image display apparatuses for color televisions, personal computers and the like. However, in recent years, image display apparatuses have been required to be improved for space saving, for portability or for some other demands. In order to satisfy these demands, various types of thin image display apparatuses have been developed and commercialized.

Under these circumstances, various types of thin image display apparatuses have been researched and developed recently. In particular, liquid crystal displays and plasma displays have been developed actively. The liquid crystal displays have been applied to various types of products such as portable personal computers, portable televisions, video cameras, car-navigation systems and the like. In addition to that, the plasma displays have been applied to products such as large-scale displays, for example, 20 inch-displays or 40-inch displays.

However, there are some problems for the displays. A liquid crystal display has a narrow visual angle and a slow response. Regarding a plasma display, high brightness can't be obtained and the consumed electricity is large. A thin image display apparatus called a field emission image display apparatus has attracted considerable attention to solve these problems. The field emission image display apparatus uses field emission, i.e. a phenomenon in which electrons are emitted in a vacuum at room temperature. The field emission image display apparatus is a spontaneous luminescent type, and therefore it is possible to obtain a wide visual angle and high brightness. The spontaneous luminescent type apparatus does not require back lighting, and thus, it consumes less electric power.

An image display apparatus disclosed in Unexamined Published Japanese Patent Application (Tokkai-Hei) No. 2-33839 is known as a flat spontaneous light emission type image display apparatus with high-quality images. This is different from the above-mentioned field emission image display apparatus in the structure but uses a linear hot cathode.

FIG. 9 is a perspective exploded view showing a conventional image display apparatus. The conventional image display apparatus comprises a back electrode 100, a linear cathode 101, an electron beam-attracting electrode 102, a control electrode 103, a first focusing electrode 104, a second focusing electrode 105, a horizontal deflecting electrode 106, a vertical deflecting electrode 107, a front glass container 109*a* having a fluorescent layer 108 on the inner surface, and a rear glass container 109*b*. The back electrode 100, the linear cathode 101, the electron beam-attracting electrode 102, the control electrode 103, the first focusing electrode 104, the second focusing electrode 105, the horizontal deflecting electrode 106 and the vertical deflecting electrode 107 are contained between the rear glass container 109*b*and the front glass container 109*a* (the fluorescent layer 108 side), and the space where those components are contained between the glass containers (109*a*, 109*b*) is maintained under a vacuum.

In the image display apparatus, electron beams are formed in a matrix by the linear cathode 101 and the electron beam-attracting electrode 102, and focused by using the first focusing electrode 104 and the second focusing electrode 105. Then, the electron beams are deflected by the horizontal deflecting electrode 106 and the vertical deflecting electrode 107 before being landed on predetermined positions of the fluorescent layer 108. The control electrode 103 controls the electron beams over time, and adjusts each electron beam independently according to picture signals for displaying pixels.

Respective components for the image display apparatuses in the conventional technique are thin and flat plates. Therefore, an image display apparatus provided by combining these components has a thin body and a flat screen.

In the conventional image display apparatus, however, forming every electrode with accuracy is difficult, since the first and second focusing electrodes (104, 105) functioning to focus electron beams are made of conductive plates provided with slender holes, while the horizontal and vertical deflecting electrodes (106, 107) to deflect the electron beams are made of two interdigital conductive plates.

More specifically, as the first focusing electrode 104 and the second focusing electrode 105 are conductive plates provided with slender holes, waviness or warping may occur in each electrode. The horizontal deflecting electrode 106 and the vertical deflecting electrode 107 are interdigital conductive plates formed by etching plate components. Therefore, waviness or warping may occur in each interdigital conductive plate as well. Moreover, each deflecting electrode is made of two interdigital conductive plates, and thus, relative deflections may occur in the deflecting electrodes for some reason.

Tokkai Hei No. 2-33839 discloses a method for manufacturing a laminated electrode, in which the laminated electrode comprises electrodes comprising separate plural conductive plates, such as the control electrode 103 and the deflecting electrodes 106, 107. When the conductive flat plates are etched to have a slit pattern in such a case, the plates are initially etched in a continuous state. These electrode plates are adhered, laminated and fixed while being insulated in a predetermined order. After that, a predetermined part is cut by using laser beams or some other means, if insulation is required in the same surface. The process of the method, however, has some problems as follows. Pattern-etching does not support the growing demand for precision, since it is difficult to treat holes whose diameter is not more than the plate thickness or residual margins. In order to stabilize the surfaces, adhesion margins should be formed with an appropriate pitch on the entire plate surface, but this is another obstacle to precision. The plates cannot be processed to be so thin for keeping surface accuracy and stiffness, but when a thick plate is etched, the configuration at the etched section is varied, which may cause errors in electron lenses. When plates etched in different shapes are adhered and laminated, the balance in the stress is lost, and warping and waviness arise. As a result, a flat surface is difficult to obtain.

When waviness or warping arises in the focusing electrodes and deflecting electrodes composing a conventional image display apparatus, it will do harm for focusing and deflection of electron beams. As a result, appropriate control of the electron beams becomes difficult, and the landing positions of the electron beams will be deviated. In such an image display apparatus, landing an electron beam on a predetermined position of the fluorescent layer 108 is difficult. As a result, problems such as error irradiation may increase, and thus, image quality of the image display apparatus will deteriorate, and an image display apparatus with high resolution cannot be easily obtained.

SUMMARY OF THE INVENTION

In order to solve the above-mentioned problems, this invention is directed to providing an image display apparatus comprising an electrode having a flat surface free from waviness or warping. Such an image display apparatus appropriately controls focusing and deflection of electron beams and prevents problems such as deviation of the electron beam landing positions and error irradiation. The image display apparatus will have excellent images and high resolution.

In order to achieve the above purposes, an image display apparatus of this invention comprises, in a vacuum container whose inside is kept under vacuum, a fluorescent layer, an electron emission source having an electron source, and electrodes for controlling electron beams emitted from the electron emission source. In the image display apparatus in which the fluorescent layer is illuminated by the electron beams, at least one of the electrodes is formed by stringing wires on a frame of a resilient material. The two opposing sides of the frame on which wires are strung are flat plates formed on the same surface, and the electrodes are arranged between the fluorescent layer and the electron emission source.

In the image display apparatus, the frame is flat and arranged on a surface, and the electrode is formed by stringing wires on the frame. Therefore, considerably flat electrodes can be obtained without any additional processes. Such a flat electrode is free from waviness and warping, and it can control electron beams appropriately. As the frame has a certain resilience and the wires are provided with a certain tensile force by the frame, the flatness of the wires can be maintained efficiently due to the tensile force. Such an electrode can be made thin, and therefore plural electrodes can be arranged in a narrow space. Therefore, a pitch between the electrodes can be decided without limitation. As the electrode is formed by stringing wires on a flat frame, both surfaces of the frame can be used. If the frame is formed by providing a difference in level in the opposing two sides, more wire electrodes including a vertical one can be arranged in one frame. If the electrodes are used for deflection, at least the adjacent wires should be insulated so that different voltages can be applied to the adjacent wires. The flat frame can achieve such a purpose easily by printing a wiring pattern and stringing the wires to be fixed thereon. As the electrodes are composed of wires, the pitch between the electrodes (wires) can be made finer in a relatively simple manner, and thus, the resolution can be improved. In this embodiment, an image display apparatus is made by using considerably flat electrodes that can provide a fine pitch easily. As a result, an image display apparatus with excellent images and high resolution can be obtained.

Preferably in the image display apparatus of the invention, the electron source is divided and arranged in a matrix. A preferable image display apparatus of this invention has electron sources that can be driven equivalently in a matrix. There is no specific limitation on the configuration of the electron source. For example, an electron source, which is divided and arranged in stripes, or which is arranged continuously over a surface of a substrate, may be used. Any electron source can be used if it can emit electron beams in a matrix. For example, an electron emission source, which is composed of a surface conductive component composed of a thin film of $SnO_2$(Sb) or a thin film of Au and the like or a thin film of some other material, a microchip type electric field electron emission component such as Spindt type (microchip cathode of field emission type invented by Spindt), an electric field electron emission component having the MIM type structure or the similar structure or a cold cathode ray component composed of an electron emission material which is carbon material such as diamond, graphite, DLC (Diamond Like Carbon) and the like, may be used.

Preferably in an image display apparatus in this invention, the difference between the coefficient of thermal expansion of the component where the fluorescent layer is formed and that of the frame is within $8\times10^{-7}/°$ C. in a temperature range from 0 to 150° C. In this preferable example, even if the internal temperature rises during the operation of the image display apparatus, the deviation generated-over time between the stripe pitch-of the fluorescent layer and the wires' pitch can be controlled within a range not affecting the practical performance of the device, since the difference between the coefficient of the thermal expansion of the component having the fluorescent layer and that of the frame is determined as mentioned above within the temperature range in the operation of the image display apparatus. As a result, the deviation of the landing positions of the electron beams at the operation can be prevented efficiently.

In a preferable image display apparatus of this invention, the frame is composed of a first frame member, a second frame member and an insulating layer, where the first frame member and the second frame member are laminated via the insulating layer, and the wires are strung on the surfaces of the first and second frame members not contacting with the insulating layer. In this preferable example, the frame is made by laminating the first frame member and the second frame member via the insulating layer. As a result, a pair of insulated electrodes (wires) sandwiching electron beams can be formed easily by stringing the wires on the respective surfaces of the first frame member and of the second frame member not contacting with the insulating layer. According to this embodiment, a pair of insulated electrodes (wires) to control respective electron beams (e.g., focusing and deflection) can be formed without carrying out additional wiring.

Preferably in the image display apparatus, the opposing two sides of the frame to which the wires are fixed are made of metal, and insulating films are formed on the surfaces of the opposing two sides. In addition, a conductive part is patterned on the insulating films, and the wires are strung to contact with the conductive parts. In this preferable example, electrodes such as a signal control electrode or other electrodes (e.g., deflecting-correcting electrode) having various voltages in the same surface can be formed with high accuracy in a relatively simple manner.

Preferably in the image display apparatus of this invention, the insulating films are formed by using a thermally-sprayed alumina layer and glass frit while the conductive parts are made of silver paste.

Preferably in the image display apparatus, the fluorescent layer is formed on the inner surface of the vacuum container. In this preferable example, the vacuum container and the fluorescent layer are integrally formed, so that the manufacturing process is simplified and the process steps can be decreased.

DETAILED DESCRIPTION OF THE PREFERRED EMBODIMENT

Hereinafter, embodiments of a display of this invention will be described referring to the accompanying drawings.

A First Embodiment

Figure 1:
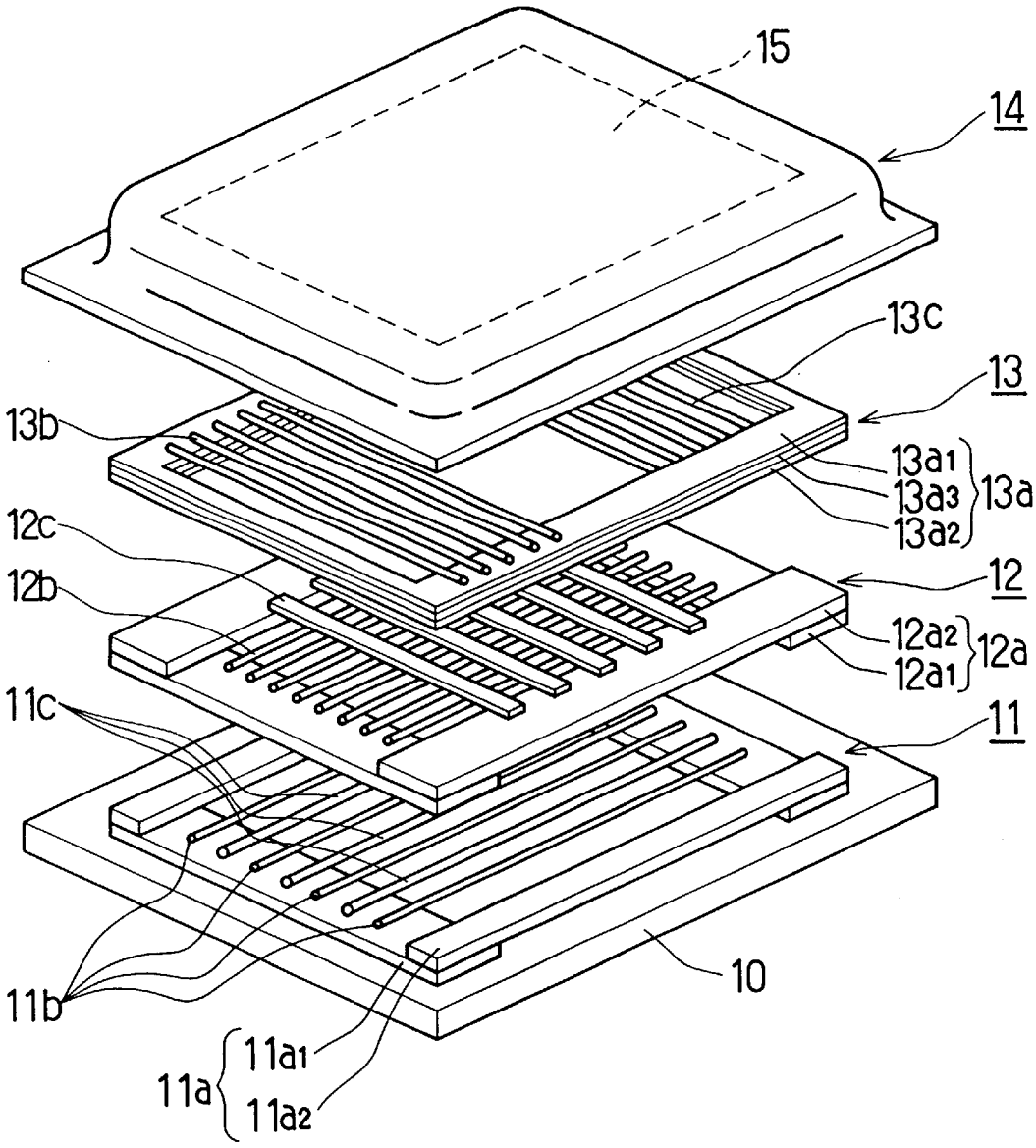
FIG. 1 is a perspective exploded view showing an image display apparatus in a first embodiment of this invention.

FIG. 1 is a perspective exploded view showing an image display apparatus in a first embodiment of this invention. As shown in FIG. 1, an image display apparatus in the first embodiment comprises a rear container 10, a first electrode part 11, a second electrode part 12, a third electrode part 13 and a front glass container 14 having a fluorescent layer 15 on the inner surface. The electrode parts (11, 12, and 13) are contained between the rear container 10 and the front glass container 14 and laminated. The space formed by the rear container 10 and the front glass container 14 to contain the components is kept under a vacuum, for example, in a range between about $1\times10$ and $1\times10^{-8}$ torr.

The first electrode part 11 comprises a first frame 11*a*, wires 11*b* functioning as a cathode (an electron source) and wires 11*c* functioning as a vertical deflecting electrode. The first frame 11*a* comprises a pair of oppositely-arranged lower frames 11*a*, and a pair of oppositely-arranged upper frames $\mathbf{11}a_2$. The wires 11*b* and the wires 11*c* are arranged alternately on the first frame 11*a*. Specifically, the cathode wires 11*b* and the vertical deflecting electrode wires 11*c* are strung to span the pair of lower frames 11*a*, and arranged in parallel. When the cathode 11*b* and the vertical deflecting electrode 11*c* are strung as wires, there is no need to form adhesion margins and feeding circuits respectively in the image area for the cathode 11*b* and the vertical deflecting electrode 11*c*. As a result, the vertical deflecting electrode 11*c* can be arranged on the same surface as the cathode 11*b*, and efficient deflection can be conducted from the moment that electron beams are first emitted.

The second electrode part 12 comprises a second frame 12*a*, wires 12*b*functioning as an electron beam-attracting electrode (hereinafter, an attracting electrode), and ribbon electrodes 12*c*, where the wires 12*b* and the ribbon electrodes 12*c* are arranged on the second frame 12*a*. The second frame 12*a* comprises a pair of oppositely-arranged lower frames $\mathbf{12}a_1$ and a pair of oppositely-arranged upper frames $\mathbf{12}a_2$. The ribbon electrodes 12*c* function to form proper electron beams by eliminating unnecessary electron beams, and also function as an electron lens. Specifically, the attracting electrodes 12*b* are strung to span the pair of lower frames $\mathbf{12}a_1$ so that the respective wires are arranged in parallel. The ribbon electrodes 12*c* are strung to span the pairs of upper frames $\mathbf{12}a_2$ and are arranged in parallel. The attracting electrode 12*b* and the ribbon electrodes 12*c* are arranged perpendicularly without contacting with each other.

The third electrode part 13 comprises a third frame 13*a*, wires 13*b* functioning as a horizontal deflecting electrode, and wires 13*c* functioning as a signal electrode (control electrode). The third frame 13*a* comprises an upper frame $\mathbf{13}a_1$, a lower frame $\mathbf{13}a_2$ and an insulating layer $\mathbf{13}a_3$. The wires 13*b* are arranged on the upper surface of the third frame 13*a* (the upper frame $\mathbf{13}a_1$ side) and the wires 13*c* are arranged on the lower surface of the same third frame 13*a* (the lower frame $\mathbf{13}a_2$ side). Specifically, the horizontal deflecting electrode 13*b* and the signal electrode 13*c* are strung on the surface of the upper frame $\mathbf{13}a_1$ and the lower frame $\mathbf{13}a_2$ respectively not contacting with the insulating layer $\mathbf{13}a_3$, with an appropriate pitch between the respective wires, and the wires are arranged in parallel.

The electrode parts 11, 12 and 13 are respectively formed with frames 11*a*, 12*a*, and 13*a*. These frames 11*a*, 12*a* and 13*a* respectively have two opposing sides that are flat plates arranged on the same surface. Therefore, the electrode parts 11, 12 and 13 which are formed by stringing wires on the frames 11*a*, 12*a* and 13*a* have considerably flat surfaces free from waviness or warping. Moreover in this embodiment, respective wires can be insulated easily. Using this advantage, wiring is carried out appropriately on the frames 11*a*, 12*a* and 13*a* according to the functions of the electrode parts. For example, in the attracting electrode 12*b*, wiring is performed on the pair of lower frames $\mathbf{12}a_1$ in order to attract electron beams into any desired raster positions. The electrode parts 11, 12 and 13 are laminated with a certain pitch via insulating members. Such an insulating member can be a member different from the frame, or it can be an insulating film of alumina or the like formed on the surface of the frame. The lamination can be fixed by using a fastener such as a screw or by using an adhesive. As described above, the embodiment of this invention does not require a specific spacer that will function as an adhesive while maintaining insulation. As a result, the distances between the electrode parts are selected to acquire the maximum effect for each electrode part without any limitation by the thickness of the spacers during the insulation and adhesion.

In the image display apparatus of this embodiment, electron beams are formed in a matrix by the cathode 11*b*, the attracting electrode 12*b* and the ribbon electrodes 12*c*. Images are displayed by controlling appropriately these electron beams by using the vertical deflecting electrode 11*c*, the ribbon electrodes 12*c*, the horizontal deflecting electrode 13*b* and the signal electrode 13*c*, and by landing the electron beams on predetermined positions of the fluorescent layer 15.

These components are thin and flat plates. Therefore, plural electrode parts can be arranged easily in a narrow space, and there is no limitation in deciding the distance between the electrode parts. As a result, an image display apparatus prepared by assembling these components has a thin body and a flat screen.

Figure 2:
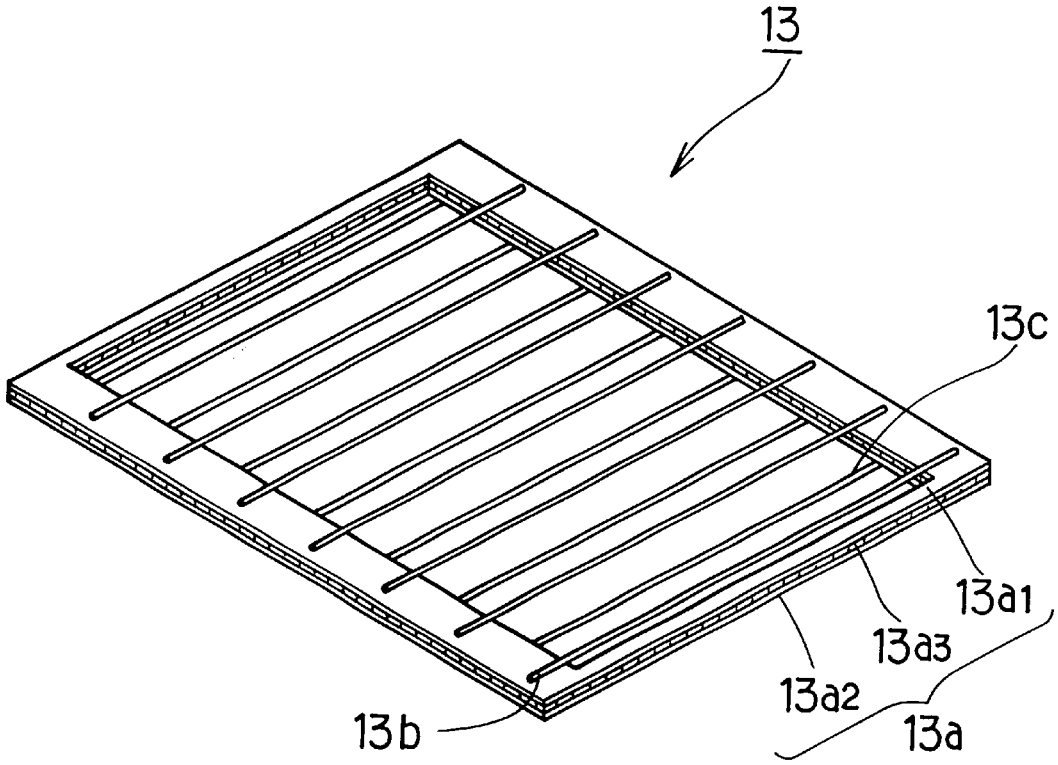
FIG. 2 is a perspective view showing one of the electrode parts composing the image display apparatus shown in FIG. 1.

FIG. 2 is a perspective view showing the third electrode part 13 composing the image display apparatus shown in FIG. 1. As shown in FIG. 2, the third electrode part 13 comprises a third frame 13*a*, wires 13*b* functioning as a horizontal deflecting electrode and wires 13*c* functioning as a signal electrode (control electrode). The third frame 13*a* comprises an upper frame $\mathbf{13}a_1$, a lower frame $\mathbf{13}a_2$ and an insulating layer $\mathbf{13}a_3$. As mentioned above, the horizontal deflecting electrodes 13*b* and the signal electrodes 13*c* are strung on the surface of the upper frame $\mathbf{13}a_1$ and the lower frame $\mathbf{13}a_2$ respectively not contacting with the insulating layer $\mathbf{13}a_3$, with an appropriate pitch between respective wires, and the wires are arranged in parallel.

This third frame 13*a* is explained more specifically as follows.

The insulating layer $\mathbf{13}a_3$ is formed by applying an insulating film to a resilient and heat-resistant material that can be used in vacuum. The material is, for example, an invar alloy, a 42-6 alloy (42-Ni, 6-Cr, Fe alloy), or stainless steel. In other words, the insulating layer $\mathbf{13}a_3$ is formed by applying an alumina layer on a substrate comprising the above-identified material by a thermal spray, and by applying glass frit thereon. An insulating film having a sufficient withstand voltage can be easily formed by thermally spraying alumina. However, some printable wiring materials such as silver paste will soon sink into the porous alumina film, so stable wiring cannot be conducted. In order to form a precise and stable insulating film, glass frit is applied and baked after thermal spraying of alumina in this embodiment.

The upper frame 13*a*, and the lower frame $\mathbf{13}a_2$ composing the conductive part are formed by using silver paste etc. on both surfaces of the insulating layer $\mathbf{13}a_3$. More specifically, the third frame 13*a* is formed by adhering the upper frame $\mathbf{13}a_1$ and the lower frame $\mathbf{13}a_2$ via the insulating layer $\mathbf{13}a_3$. This third frame 13*a* is shaped to maintain the strung wires 13*b* and 13*c* on a flat surface. An example of the frame has a shape whose center part is vacant and which has only four edges.

For the wires 13*b* and 13*c*, a resilient and heat-resistant wiring material that can be used in vacuum is used. The material is a wiring material of 10 to 100 $\mu$m, such as an invar alloy, a 42-6 alloy (42-Ni, 6-Cr, Fe alloy), and stainless steel. Alternatively, wiring materials, such as tungsten and nickel that can be obtained easily as wire materials with a diameter similar to that of the steel wires, can be used. The wires 13*b* are strung and held between two opposing edges of the upper frame $\mathbf{13}a_1$ not contacting with the insulating layer $\mathbf{13}a_3$. The wires 13*c* are strung and held between opposing edges of the lower frame $\mathbf{13}a_2$ not contacting with the insulating layer $\mathbf{13}a_3$, and the wires 13*c* are arranged to be parallel with the wires 13*b*. As the wires 13*b* and 13*c* are strung and held to be straight, the flatness of the wires 13*b* and 13*c* on the surfaces of the third frame 13*a* (the surfaces of the upper frame $\mathbf{13}a_1$ and the lower frame $\mathbf{13}a_2$, which are not contacted with the insulating layer $\mathbf{13}a_3$) is maintained with high accuracy. The third frame 13*a* has a certain resilience, and the wires 13*b* and 13*c* are provided with a certain tensile force by this third frame 13*a*. Therefore, the flatness of the wires 13*b*and 13*c* can be maintained more efficiently due to the tensile force.

As mentioned above, the third frame 13*a* composing the third electrode part 13 of this embodiment is made by adhering the upper and lower frames ($\mathbf{13}a_1$, $\mathbf{13}a_2$) as conductive parts to sandwich the insulating layer $\mathbf{13}a_3$. As a result, an electrode that can control electron beams efficiently can be easily formed by carrying out the wires 13*b* and 13*c* on both surfaces of the third frame 13*a* by conducting wiring or the like on the third frame 13*a*. The wires 13*b* and 13*c* are strung and held with an equal pitch respectively on the upper and lower surfaces of the third frame 13*a*. By applying proper voltage to each of the wires 13*b* and 13*c*, the wires 13*b* function as a horizontal deflecting electrode and the wires 13*c* function as a signal electrode.

In the third electrode part 13, the respective electrodes are formed by using wires 13*b* and 13*c*. As a result, a third electrode part 13 having improved flatness can be obtained by stringing and holding the wires 13*b* and 13*c* on the third frame 13*a*, if the third frame is free from problems such as waviness and warping and if only the surface accuracy (flatness) of the third frame can be maintained appropriately, since the surface formed by the wires becomes flat. When an image display apparatus is formed by using such a third electrode part 13 with high flatness, the electron beams can be controlled properly and, an image display apparatus displaying excellent images can be obtained. As the respective electrodes are formed by using the wires 13*b* and 13*c*, the space between the electrodes can be narrowed (the pitch between the electrodes made finer) in a relatively simple manner. The finer the pitch is, the higher resolution can be obtained. As a result, an image display apparatus with high resolution can be obtained.

The fluorescent layer 15 in this embodiment is directly formed on the inner surface of the front glass container 14. The materials of the components comprising the front glass container 14 and the frames (11*a*, 12*a* and 13*a*) composing the electrode parts (11, 12, and 13) are selected so that the difference between the coefficient of thermal expansion of the front glass container 14 and that of the frames (11*a*, 12*a*, 13*a*) is within $8\times10^{-7}$/° C. in a temperature range from 0 to 150° C. According to this, when such an image display apparatus is operated and the internal temperature rises, the difference between the coefficient of thermal expansion between the front glass container 14 having the fluorescent layer 15 and the that of the frames (11*a*, 12*a*, 13*a*) of the electrode parts (11, 12, 13) is set to be small as mentioned above within the temperature range in the operation of the image display apparatus. Therefore, the deviation of the stripe pitch of the fluorescent layer 15 from the pitch of the wires strung on the frames 11*a*, 12*a* and 13*a* can be controlled over time in a range not affecting the practical performance.

In this embodiment, all electrodes composing the image display apparatus are formed by using wires, excepting the ribbon electrodes. This invention, however, is not limited thereto. For example, an image display apparatus can be formed by using wires only for an electrode that requires special accuracy and precision while making the other electrodes in a conventional technique (etched electrodes), and assembling these electrodes. A certain effect as mentioned above can be also obtained in this structure by providing a wire electrode.

A Second Embodiment

Figure 3:
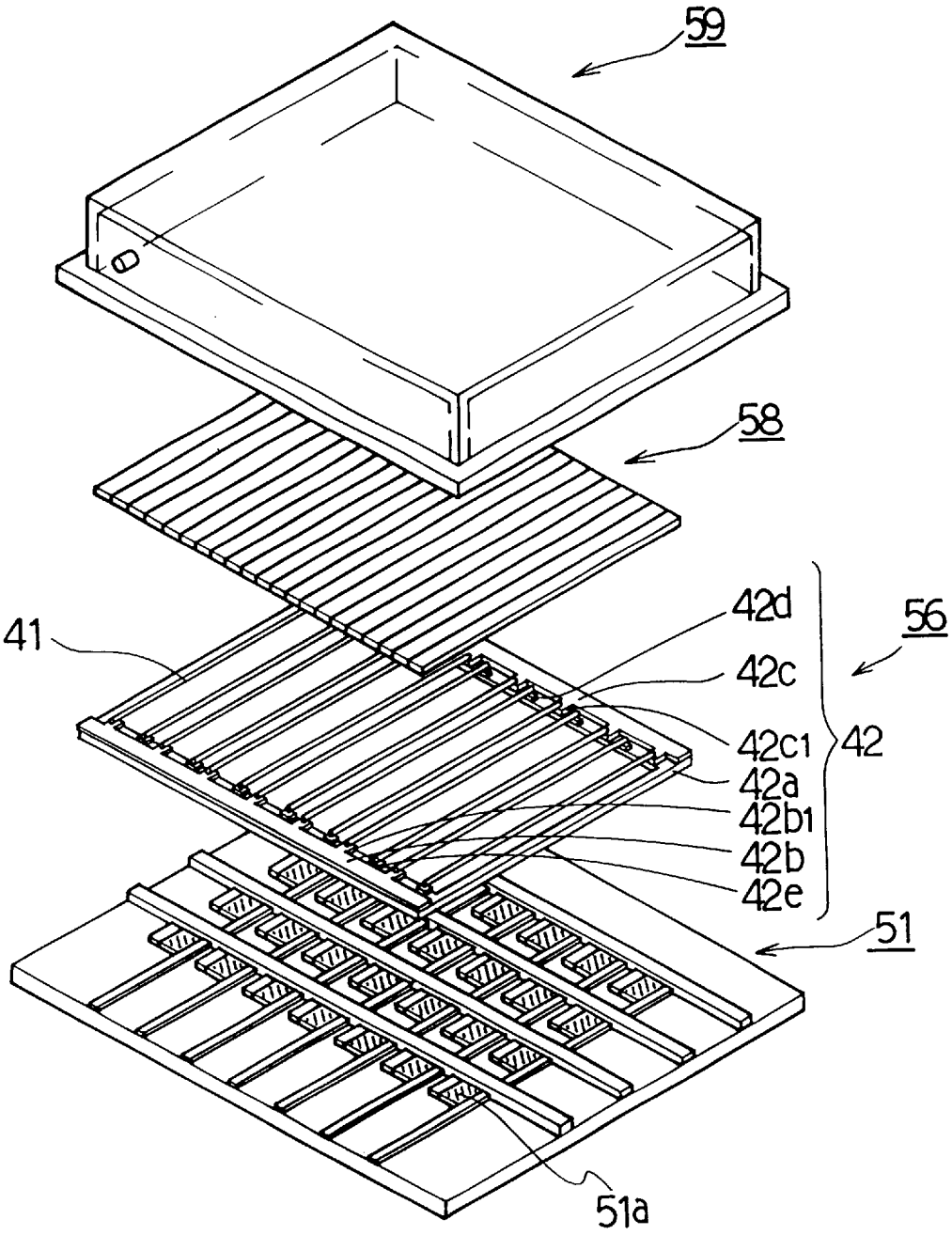
FIG. 3 is a perspective exploded view showing an image display apparatus in a second embodiment of this invention.

FIG. 3 is a perspective exploded view showing an image display apparatus in a second embodiment of this invention. As shown in FIG. 3, an image display apparatus in the second embodiment of this invention comprises an electron emission source 51, an electrode 56, a fluorescent layer 58 and a vacuum container 59. The electron emission source 51 comprises a plurality of electron sources 51*a* arranged in a matrix, and the electrode 56 has a function for deflecting and focusing electron beams emitted from the electron emission source 51. The fluorescent layer 58 is excited by electron beams to emit light. The vacuum container 59 contains the electron emission source 51, the electrode 56 and the fluorescent layer 58, and the inside of the vacuum container 59 is kept under vacuum. The electrode 56 is arranged between the electron emission source 51 and the fluorescent layer 58. The fluorescent layer 58 is provided at a position that contacts with the inner surface of the vacuum container 59. The part of the vacuum container 59 that contacts with the fluorescent layer 58 is made of transparent material in order to observe a light emitted by the fluorescent layer 58 from the outside. The inside of the vacuum container 59 may have a degree of vacuum in a range between $1\times10^{-6}$ and $1\times10^{-8}$ torr.

Any type of an electron emission source 51 can be used as long as it can emit electron beams in a matrix. For example, an electron emission source, which is composed of a surface conductive element composed of a thin film of $SnO_2$(Sb) or a thin film of Au and the like or a thin film of some other material, a microchip type electric field electron emission element such as Spindt type (microchip cathode of field emission type invented by Spindt), an electric field electron emission element having the MIM type structure or the similar structure or a cold cathode ray element composed of an electron emission material which is carbon material such as diamond, graphite, DLC (Diamond Like Carbon) and the like, may be used.

Figure 4:
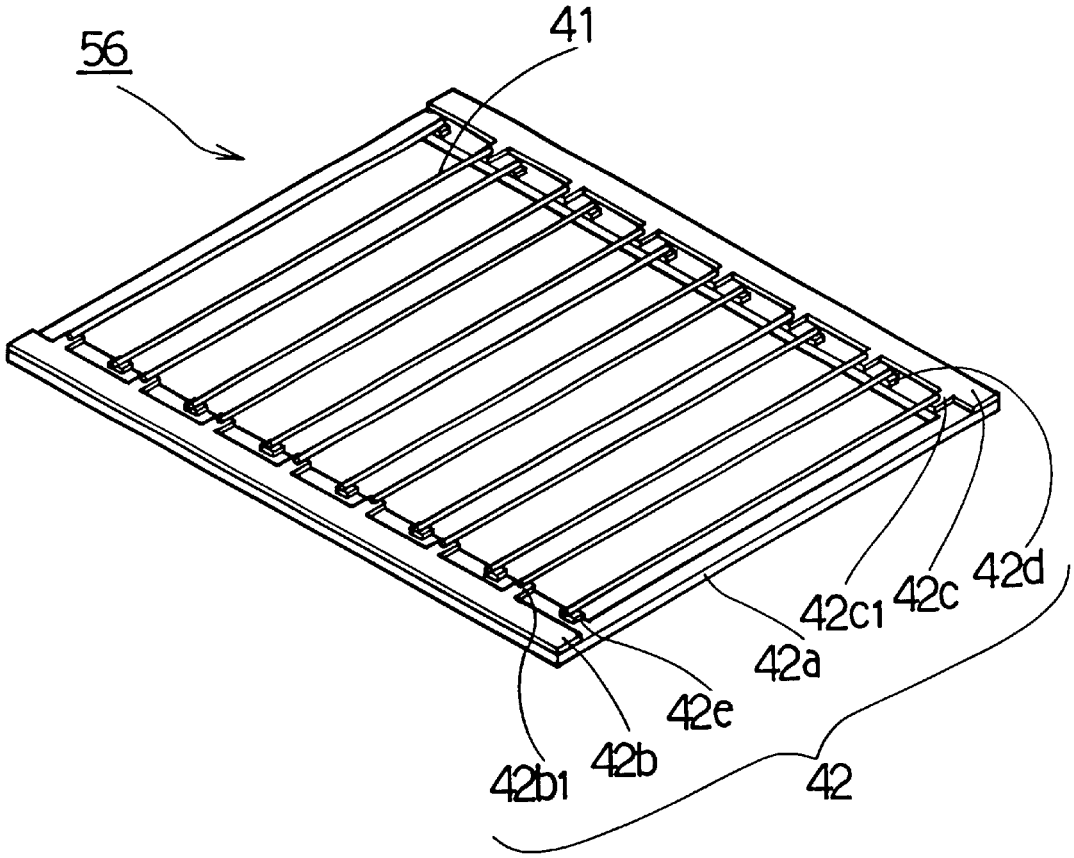
FIG. 4 is a perspective view showing the electrodes composing the image display apparatus shown in FIG. 3.

FIG. 4 is a perspective view of the electrode 56 composing the image display apparatus shown in FIG. 3. As shown in FIG. 4, the electrode 56 comprises a frame 42 and a plurality of wires 41. The frame 42 comprises a frame substrate 42*a*, a first frame part 42*b*, a second frame part 42*c*, a first conductive part 42*d* and a second conductive part 42*e*.

The frame 42 is explained below more specifically. The frame substrate 42*a* composing the frame 42 is made of a resilient and heat-resistant material that can be used in vacuum, such as, an invar alloy, a 42-6 alloy (42-Ni, 6-Cr, Fe alloy), and stainless steel. The frame parts (42*b*, 42*c*) composing the conductive parts and the conductive parts (42*d*, 42*e*) are made of silver paste or the like. An insulating film is applied on the surface of the frame substrate 42*a* (the portion contacting with the first frame part 42*b*, the second frame part 42*c*, the first conductive part 42*d* and the second conductive part 42*e*). The insulating film is made of, for example, thermally-sprayed alumina layer and glass frit in the same manner as in the first embodiment. On this insulating film, the above-mentioned conductive parts are pattern-formed.

The frame substrate 42*a* is shaped to hold the frame parts (42*b*, 42*c*) and the conductive parts (42*d*, 42*e*), and also to keep the wires 41 to be flat, when the wires 41 are strung and held between the frame parts (42*b*, 42*c*) and the conductive parts (42*d*, 42*e*). The insulating substrate 42*a* has, for example, a shape whose center part is vacant and which has only four edges. The frame parts 42*b* and 42*c* are formed respectively on the opposing edges of the frame substrate 42*a*. The first conductive part 42*d* is formed on a predetermined position of the frame substrate 42*a* so that the wires 41 can be kept flat between this conductive part 42*d* and the first frame conductive part $42b_1$ in the first frame part 42*b*. The second conductive part 42*e* is formed on a predetermined position of the frame substrate 42*a* so that the wires 41 can be kept flat between this conductive part 42*e* and the second frame conductive part $42c_1$ in the second frame part 42*c*. As mentioned above, the frame substrate 42*a* is made of an invar alloy or the like while the respective conductive parts are made of silver paste or the like, so the frame 42 in this embodiment has a predetermined resilience as a whole.

For the wires 41, a resilient and heat-resistant material that can be used in vacuum is used. The material is a wiring material of 10 to 100 $\mu$m that can be an invar alloy, a 42-6 alloy (42-Ni, 6-Cr, Fe alloy), stainless steel or the like. Alternatively, wiring materials, such as tungsten and nickel that can be obtained easily as wiring materials with a diameter similar to that of the steel wires can be used. The wires 41 are strung and held with an equal pitch between the frame conductive parts ($42b_1$, $42c_1$) and the conductive parts (42*d*, 42*e*). As the wires 41 are strung and held to be straight, the flatness of the wires 41 on the frame 42 is maintained efficiently. The frame 42 has a certain resilience, and the wires 41 are provided with a certain tensile force by this frame 42. Therefore, the flatness of the wires 41 can be maintained more efficiently due to the tensile force.

The electrode 56 in this embodiment has a structure in which the respective wires 41 are arrayed with a certain pitch on the same surface of the frame 42, as pairs of electrodes with a certain pitch. The frame 42 is shaped to hold the wires 41 and allow the scanning of the electron beams between the pairs of wires 41 arranged on the frame 42. An example of the frame has a shape whose center part is vacant and which has only four edges. The electron emission source 51, the electrode 56 and the fluorescent layer 58 are constituted such that electron beams emitted in a matrix from the electron emission source 51 pass between pairs of electrodes consisting of the wires 41, and are landed on the fluorescent layer 58.

A fluorescent layer 58 comprises a substrate such as a glass substrate on which is coated a fluorescent substance which is illuminated by irradiating with electron beams emitted from an electron emission source 51. In coating a fluorescent substance on a glass substrate, in order to provide a fluorescent layer 58 which can display a colored image, the fluorescent substance is coated in numerous stripes on the glass substrate in order of red (R), green (G) and blue (B). The stripe-arranged fluorescent substance can be provided by photolithography as in the process for forming a fluorescent layer composing a cathode ray tube, as well as printing, transferring or the like.

A vacuum container 59 is made of transparent material such as glass. This is so that light emitted from a fluorescent layer 58 can be observed from outside of the vacuum container 59 so that the vacuum container 59 functions as an image display apparatus. However, it is not required that the whole surface of the vacuum container 59 be transparent, but only the part of the vacuum container 59 that contacts with the fluorescent layer 58 is transparent (In FIG. 3, the upper area with largest surface).

In this embodiment, a case in which a fluorescent layer 58 and a vacuum container 59 are provided separately and are assembled to compose an image display apparatus was explained. According to the structure, there are merits that the design of the pressure proof image display apparatus (a vacuum container 59) can be performed regardless of the shape of the fluorescent layer 58 and that the fluorescent layer can be formed easily.

According to the image display apparatus of this embodiment, it is preferable that an area of an electron emission source 51 and an area of a fluorescent layer 58 are almost the same size and face each other completely to control electron beams. However, when a size of the image display apparatus reaches a certain size, the pressure-resistant design of the vacuum container 59 is important to maintain a vacuum for the inside of the image display apparatus. If the fluorescent layer is applied to the inside of the vacuum container, the vacuum container should be designed to have a certain thickness for resisting the vacuum while the container should be bent in accordance with the shape of the electron emission source. A design to satisfy both the requirements becomes more difficult as the image display apparatus becomes large.

Therefore, an image display apparatus is provided by providing the fluorescent layer 58 and the vacuum container 59 separately and then assembling these components, so that the vacuum container 59 can be designed in a relatively simple manner. This invention, however, is not limited to the structure. A relatively small image display apparatus can be provided by applying a fluorescent substance on the inner surface of the vacuum container 59 (the vacuum side) and integrally forming the vacuum container 59 and the fluorescent layer in order to simplify the process or to decrease the process steps. In this way, an image display apparatus with a vacuum container 59 having an inner fluorescent layer can be formed.

The electron emission source 51, the electrode 56, the fluorescent layer 58 and the vacuum container 59 are thin and flat components. Therefore, an image display apparatus of this embodiment comprises the electron emission source 51, the electrode 56 and the fluorescent layer 58 which are laminated and contained in the vacuum container 59. Accordingly, a thin image display apparatus having a flat screen can be obtained.

Figure 5:
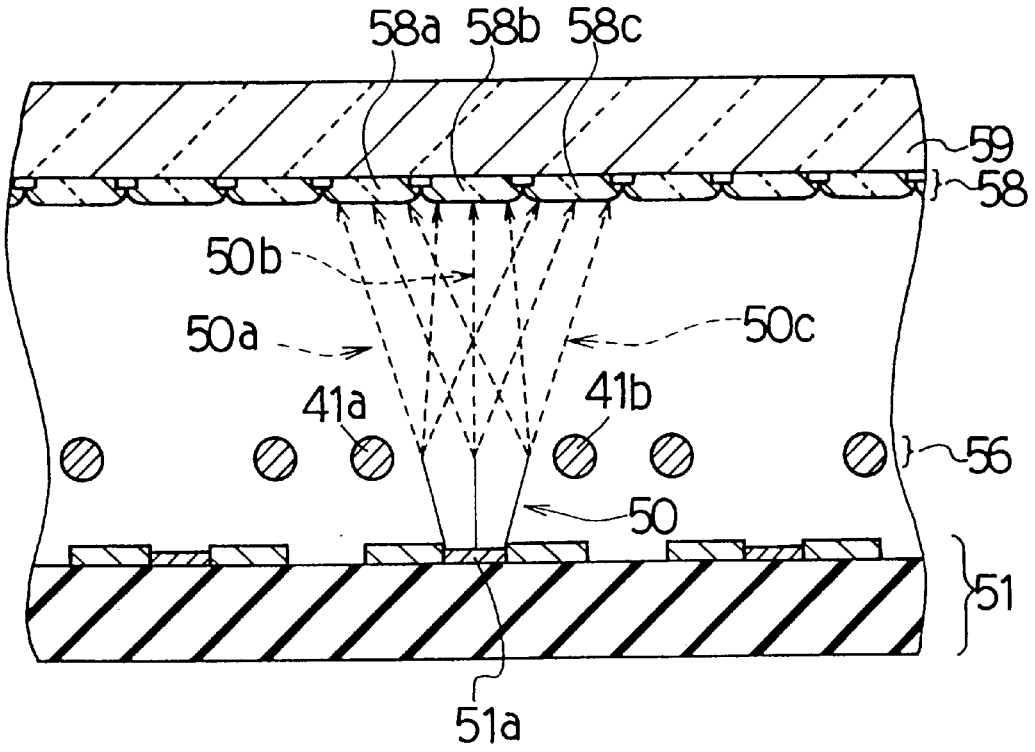
FIG. 5 is a cross-sectional view showing the schematic structure of the image display apparatus shown in FIG. 3.

FIG. 5 is a cross-sectional view showing the schematic structure of an image display apparatus shown in FIG. 3. As shown in FIG. 5, electron beams are emitted appropriately from each electron source 51*a* which composes an electron emission source 51. The electrode 56 is provided between the electron emission source 51 and the fluorescent layer 58 such that each electron beam emitted from an electron source 5la passes between a pair of electrodes which constitute the electrode 56. Hereinafter, an action and an effect of an image display apparatus of this embodiment will be explained by illustrating an action of an electron beam 50 that is emitted from the electron source 51*a*.

An electron beam 50 is emitted from an electron source 51*a* to pass between a pair of wires 41*a*, 41*b* which constitute the electrode 56, and deflected by a potential of the wire 41*a* and that of the wire 41*b* to any direction of an electron beam 50*a*, 50*b* or 50*c*. Then, the electron beam 50 is landed on any component 58*a*, 58*b* or 58*c* which constitutes a fluorescent layer 58. The pair of wires 41*a*, 41*b* are provided to sandwich the electron beam 50 in the horizontal direction. The electron beam 50 is deflected to three grades in the horizontal direction by the potential of the wire 41*a* and that of the wire 41*b*.

Figure 6:
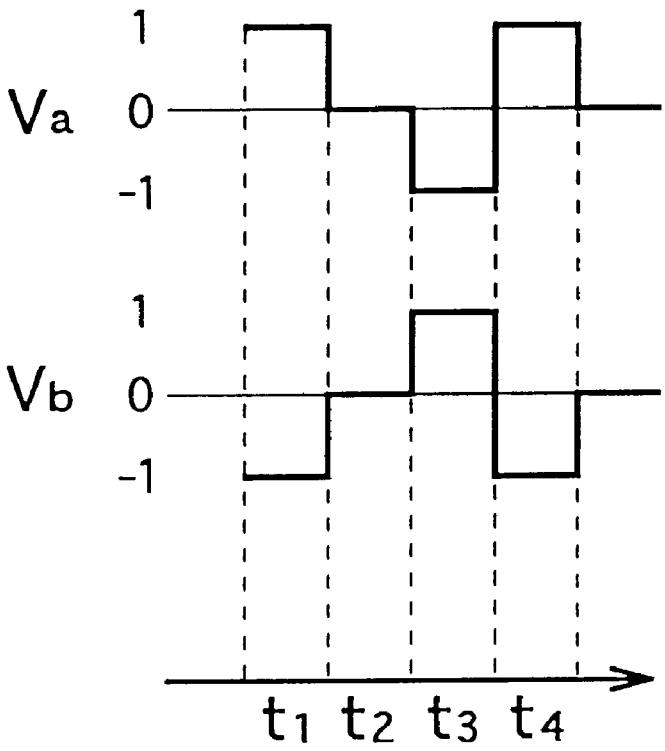
FIG. 6 is a waveform chart showing the voltage applied to the electrodes when driving (deflecting) the electron beams shown in FIG. 5.

FIG. 6 is a figure showing a wave-form of voltage applied to wires 41*a* and 41*b* when the electron beam 50 is driven (deflected). In FIG. 6, the horizontal axis shows time and the vertical axis shows a voltage. FIG. 6 shows a voltage Va that is applied to the wire 41*a* for a predetermined period and a voltage Vb which is applied to the wire 41*b* for a predetermined period.

When the time is $t_1$, a voltage of Va=1 is applied to a wire 41*a*, and a voltage of Vb=−1, is applied to a wire 41*b*. That is, the predetermined value of Va (Va=1) is applied to the wire 41*a*, and the predetermined value of Vb (Vb=−1), whose sign is different from that of Va, is applied to the wire 41*b*. Consequently, when the time is $t_1$, a potential of the wire 41*a* is higher than that of the wire 41*b*, and the electron beam 50 is deflected in the direction of the electron beam 50*a*. As a result, the electron beam 50*a* is landed on the component 58*a* of a fluorescent layer.

When the time is $t_2$, a voltage of Va=0 is applied to a wire 41*a*, and a voltage of Vb=0 is applied to a wire 41*b*. That is, the predetermined value of voltage is applied to both of wires 41*a* and 41*b* (Va=Vb=0). Consequently, when the time is $t_2$, a potential of the wire 41*a* is same as that of 41*b*, and the electron beam 50 passes straight in the direction of electron beam 50*b*. As a result, the electron beam 50*b* is landed on the component 58*b* of a fluorescent layer.

When the time is $t_3$, a voltage of Va=−1 is applied to the wire 41*a*, and a voltage of Vb=1 is applied to the wire 41*b*. That is, the predetermined value of Va (Va=−1) is applied to the wire 41*a*, and the predetermined value of Vb (Vb=1), whose sign is different from that of Va, is applied to the wire 41*b*. Consequently, when the time is $t_3$, a potential of the wire 41*b* is higher than that of the wire 41*a*, and the electron beam 50 is deflected in the direction of electron beam 50*c*. As a result, the electron beam 50*c* is landed on the component 58*c* of a fluorescent layer.

As above-mentioned, in this embodiment, an electron beam 50 is deflected by applying a voltage shown in FIG. 6 to the wires 41*a* and 41*b*. In applying a voltage to the wires 41*a* and 41*b*, the sum of the voltage applied to the wires 41*a* and 41*b* for a predetermined time is set to be the same. That is, a voltage applied to the wires 41*a* and 41*b* is set as follows. When the time is $t_1$, the sum of voltage, (Va(1)+Vb(−1)), is 0. When the time is $t_2$, the sum of voltage, (Va(0)+Vb(0)), is 0. When the time is $t_3$, the sum of voltage, (Va(−1)+Vb(1)), is 0. According to this embodiment, each voltage, Va and Vb, is set as above-mentioned, the sum of a potential of electrode 56 can be kept at the same level for all the time, and in deflecting electron beams, there is not any fluctuation of potential. Consequently, an image display apparatus that can provide a stable picture can be obtained.

As above-mentioned, an electron beam 50 is deflected and also focused before it is landed on a fluorescent layer 58. In this embodiment, in order to focus the electron beam 50, an electric field strength between an electron emission source 51 and a fluorescent layer 58 is controlled. Specifically, a potential that is applied to the electrode 56 is controlled so that the average electric field strength between a fluorescent layer 58 and electrode 56 becomes stronger than that between electrode 56 and an electron emission source 51. Accordingly, the electron beam 50 that passes between a pair of electrodes (wires) can be deflected appropriately and focused to be landed on any component 58*a*, 58*b* or 58*c* of a fluorescent layer while being focused.

The electrode 56 composing the image display apparatus of this embodiment comprises a frame and wires just like the electrode parts composing the image display apparatus in the first embodiment. Therefore, the electrode 56 will be very flat by only stringing and holding the wires 41 on the frame 42 if the frame 42 is free from waviness or warping and keeps the surface accuracy (flatness) properly. An image display apparatus comprising such an electrode 56 having high flatness can control electron beams appropriately in the same way as the first embodiment, and can display excellent images. Moreover, the spaces between the electrodes can be narrowed (the pitch between the electrodes is made finer) in a relatively simple manner, since each electrode is made of wires 41. If the pitch between the electrodes can be made finer, the resolution in the horizontal direction can also be raised, and thus, an image display apparatus having high resolution can be obtained.

As mentioned above, an image display apparatus of this embodiment comprises a considerably flat electrode 56 functioning to control the deflection action and focusing action of the electron beam 50, and the electrode 56 is arranged between the electron emission source 51 and the fluorescent layer 58. The image display apparatus provided with the electrode 56 can focus and deflect the electron beam 50 to land the electron beams 50*a*, 50*b* and 50*c* on desired components 58*a*, 58*b* and 58*c* of the fluorescent layer. In this embodiment, therefore, error irradiation is prevented by focusing the electron beam 50, and the electron beam 50 is landed on the fluorescent layer component having an array pitch finer than that of the electron emission source 51 (there are more components than the number of the electron sources 51*a*) by deflecting the electron beam 50 appropriately. As a result, an image display apparatus having high resolution can be obtained.

In the image display apparatus explained in this embodiment, the electron beam 50 is deflected in three grades in the horizontal direction. However, this invention is not limited thereto. For example, the electron beam 50 may be deflected to more grades by applying more grades of potential (for example, applying four or more grades of voltage) between a pair of electrodes (wires) 41*a* and 41*b*. The resolution of a display can be further increased as the number of grades of deflection is raised.

In the image display apparatus explained in this embodiment, the electron beam 50 is deflected in the horizontal direction. However, this invention is not limited thereto. For example, an image display apparatus in which the electron beam 50 is deflected in the vertical direction may be used. In addition to that, an image display apparatus in which the electron beam 50 is deflected in both directions, that is, both the horizontal direction and the vertical direction, may be used. In order to deflect the electron beam 50 in the vertical direction, a pair of wires 41*a* and 41*b* which constitute an electrode 56 has to be arranged between an electron emission source 51 and a fluorescent layer 58, so that the pair of wires 41*a* and 41*b* sandwich the electron beam 50 in the vertical direction. In order to deflect electron beams both in the horizontal and the vertical directions, in addition to the electrode 56 explained in this embodiment, another electrode having the same structure as that of the electrode 56 may be arranged between the electron emission source 51 and the fluorescent layer 58, so that a pair of electrodes which constitute another electrode sandwich electron beams in the vertical direction.

An electrode for the image display apparatus in this embodiment is not limited to the electrode 56 shown in FIG. 4, but an image display apparatus with high performance can be provided by using the electrode shown in FIG. 2. The electrode in FIG. 2 is constituted by sandwiching an insulating layer 13$a_3$ with two metal layers and adhering them. Therefore, an electrode to control (e.g., focus and deflect) electron beams can be formed easily without wiring, but by only stringing wires 13*b* and 13*c* on both surfaces of the third frame 13*a*. An image display apparatus comprising such an electrode also can reduce the number of the process steps. The electrode shown in FIG. 4 also can be used for the image display apparatus in the first embodiment.

In an image display apparatus in this embodiment, as in the case of the first embodiment, the materials for the components are selected so that the difference between the coefficient of thermal expansion of the component on which the fluorescent layer 58 is formed and that of the frame 42 is within $8\times10^{-7}/°$ C. in a temperature range from 0 to 150° C. In such a constitution, even if the internal temperature rises in the operation of the image display apparatus, the deviation generated over time between the stripe pitch of the fluorescent layer 58 and the wires' pitch can be controlled within a range not affecting the practical performance, since the difference between the coefficient of the thermal expansion of the components on which the fluorescent layer 58 is formed and that of the frame 42 holding the respective electrodes (wires) is determined to be small as mentioned above within the temperature range in the operation of the image display apparatus.

A Third Embodiment

Figure 7:
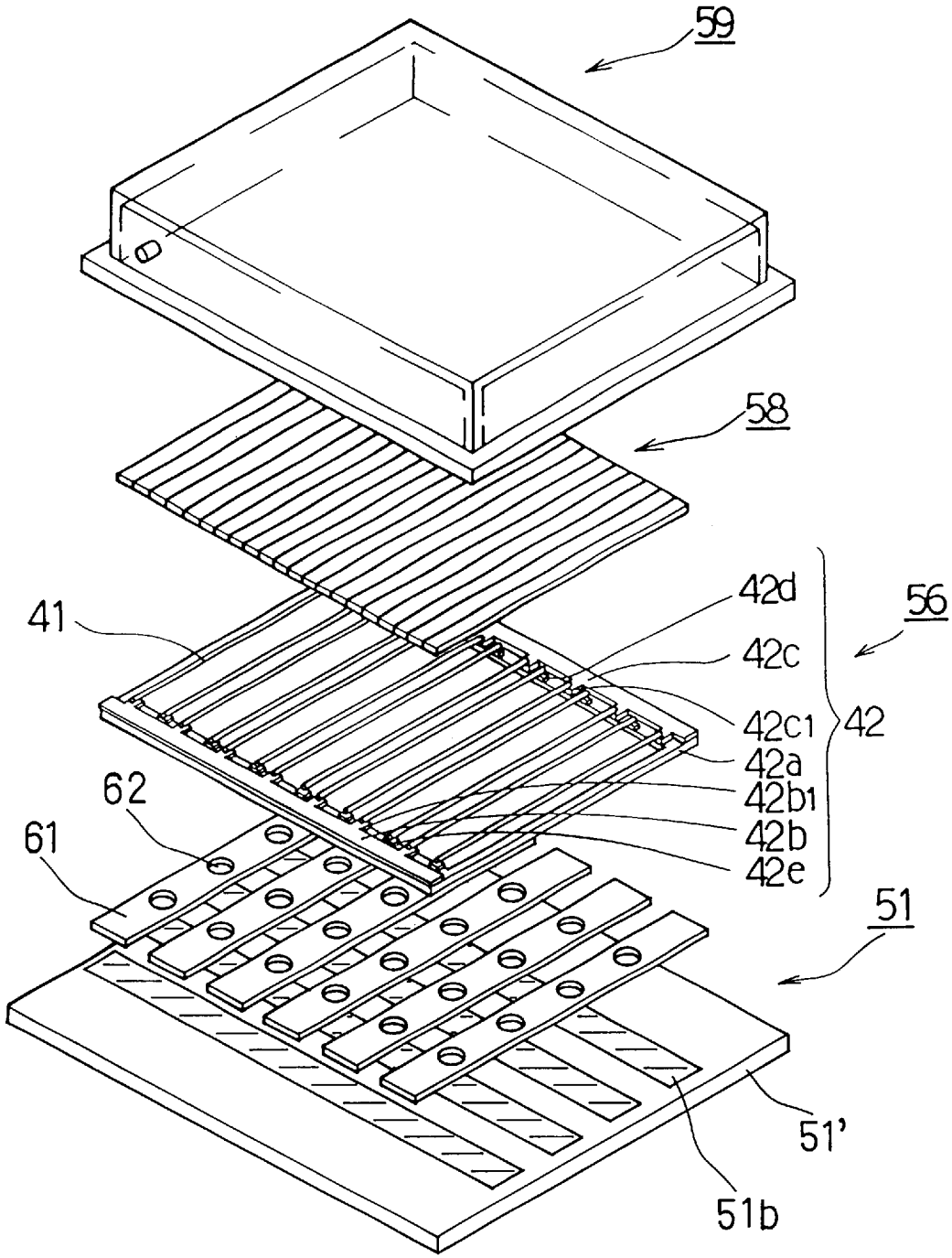
FIG. 7 is a perspective exploded view showing an image display apparatus in a third embodiment of this invention.

FIG. 7 is a perspective exploded view showing an image display apparatus in a third embodiment of this invention. Basically, an image display apparatus of this embodiment has the same structure as that of the second embodiment (refer to FIG. 3) excepting the structure of the electron emission source. As shown in FIG. 7, control electrode 61 is provided additionally, and the patterned geometry of an electron source 51*b* on an insulating substrate 51' is changed from that of the second embodiment.

The control electrode 61 is divided electrically and arranged in stripes, and holes 62 are provided at the positions where predetermined electron beams pass through so that electrons can pass through the holes 62. In the same way, an electron source 51*b* formed on the insulating substrate 51' is patterned in a stripe in the direction which is perpendicular to the dividing direction of the control electrode 61 and the electron sources are separated electrically. Further, when electrons are not emitted, the potential of the control electrode 61 to the potential of the stripe-arranged electron source 51*b* is negative or the potential difference between the control electrode 61 and the strip-arranged electron sources 51*b* is very low.

When the potential of some control electrode 61 is selected to be positive, and the potential of some stripe-arranged electron sources 51*b* is selected to be negative, only the potential difference of the cross section of the selected control electrode and the selected stripe-arranged electron sources becomes large, and electrons are emitted from the cross section of the electron source 51*b* (attraction of electron). Electrons emitted from the selected cross section pass through holes 62 provided on a control electrode 61 (selective transmission) in the direction of a fluorescent layer 58. After that the electrons pass in the same way as those of the second embodiment, and therefore the explanation will be omitted.

According to the image display apparatus having the above-mentioned structure and function of this embodiment, even if electron sources are not provided in a matrix on essentially the same surface, the electron sources can be used as an electron source which can emit electron beams in a matrix by providing a control electrode 61 additionally. That is, the combination of the control electrode 61 having the above-mentioned structure and the electron source 51*b* can be considered as an electron emission source having electron sources arranged in a matrix.

Further, in the above-mentioned embodiment, the control electrode 61 is provided on one surface. However, a function of attracting electrons due to the potential difference and a function of selective transmission may be achieved by at least two electrodes, for example, a plurality of electrodes may be provided in the direction in which electrons are emitted from electron sources. According to the above-mentioned structure, the same effect can be obtained.

The above-mentioned control electrode can be made of wires.

A Fourth Embodiment

Figure 8:
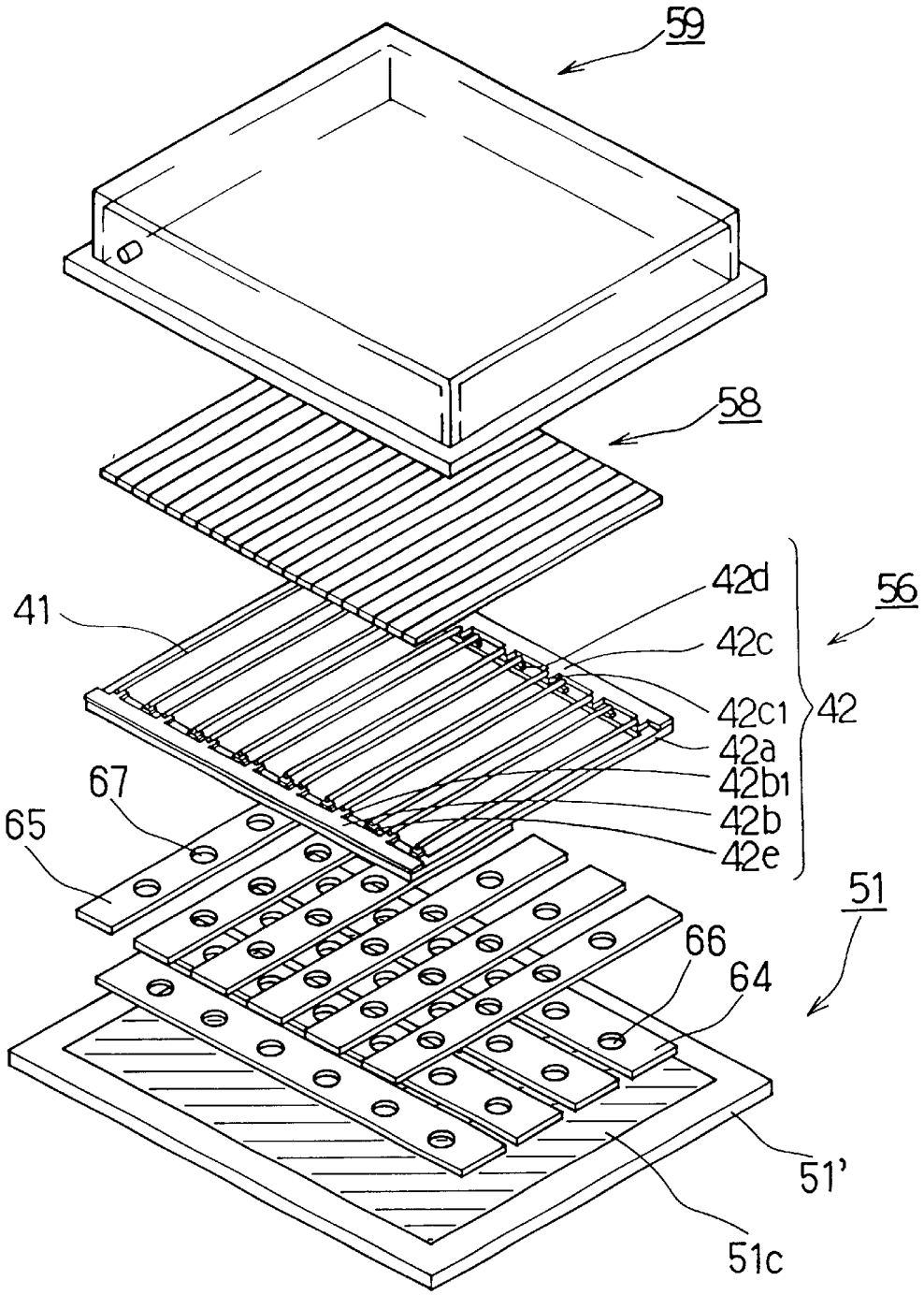
FIG. 8 is a perspective exploded view showing an image display apparatus in a fourth embodiment of this invention.
Figure 9:
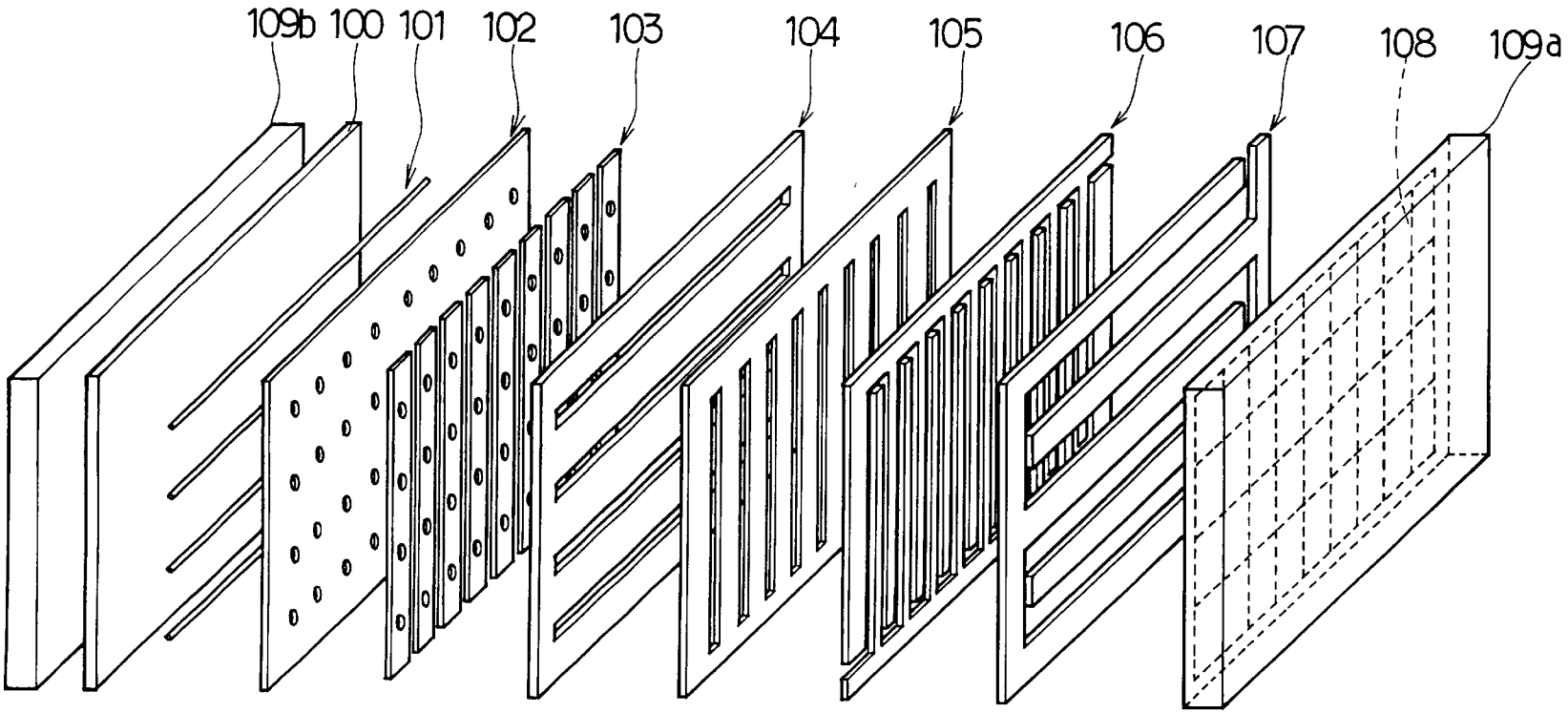
FIG. 9 PRIOR ART
FIG. 9 is a perspective exploded view showing a conventional image display apparatus.

FIG. 8 is a perspective exploded view showing an image display apparatus in a fourth embodiment of this invention.

Basically, an image display apparatus of this embodiment has the same structure as that of the second embodiment (refer to FIG. 3) excepting the structure of the electron emission source. As shown in FIG. 8, an electron source 51*c* is arranged continuously over the surface and a plurality of control electrodes, 64 and 65 are provided respectively above the electron source 51*c* to emit electrons from the electron source 51*c*.

As shown in FIG. 8, the control electrodes 64 are divided electrically and arranged in stripes, and holes 66 are provided on the control electrodes 64 at the positions where a predetermined electron beam passes through so that electrons can pass through the holes 66. In the same way, control electrodes 65 are divided electrically and arranged in stripes, and holes 67 are provided on the control electrodes 65 at the position corresponding to the holes 66. Consequently, an electron that passes through a hole 66 can pass through a hole 67. The control electrodes 64 and 65 are arranged to cross at right angles. An electron source 51*c* is arranged continuously over the surface of the insulating substrate 51'. Further, when electrons are not emitted, the potential of the control electrodes 64 to the potential of the plane-formed electron source 51*c* is negative or the potential difference between the control electrodes 64 and the plane-formed electron source 51*c* is very low.

When the potential of some control electrodes 64 is selected to be positive, only the potential difference of the stripe part of the selected control electrode 64 becomes large, and electrons are emitted from the parts (attraction of electron). Electrons emitted from the selected stripe parts pass through all holes 66 provided on the control electrode 64. Next, when the potential of some control electrodes 65 is selected to be positive, and the potential of other control electrodes 65 is selected to be a cutoff potential, only the electron passing through a cross section of the selected control electrodes 64 and 65, of all electrons which pass through a hole 66, passes through a hole 67 provided on the control electrode 65 (selective transmission) in the direction of the fluorescent layer 58. After that the electrons pass in the same way as those of the second embodiment, and therefore the explanation will be omitted.

According to the image display apparatus having the above-mentioned structure and function of this embodiment, even if the electron source 51*c* is arranged continuously over the surface of the substrate, the electron source can be used as an electron source that can emit electron beams in a matrix by providing two sets of control electrodes 64 and 65. That is, the combination of the control electrodes 64 and 65 having the above-mentioned structure and the electron source 51*c* can be considered as an electron emission source having electron sources arranged in a matrix.

In the above-mentioned embodiment, two sets of control electrodes are provided. However, an electrode having a function of attracting electrons due to the potential difference may be provided additionally and a function of selective transmission may be achieved by two sets of control electrodes. That is, at least three sets of electrodes may be provided. According to the above-mentioned structure, the same effect can be obtained.

The control electrodes also can be made of wires.

In the image display apparatuses explained in the first to the fourth embodiments, the positions of the electron emission sources, the respective electrodes and the fluorescent layers are adjusted precisely. In assembling an actual image display apparatus, however, the positions that the electron beams are landed on the fluorescent layer may be deviated because of errors during manufacturing or assembling the components. Although the closest attention is paid in designing and manufacturing, it is very difficult to solve all deviations. Once the landing positions of the electron beams are deviated, more problems such as error irradiation will occur. As a result, image quality of the image display apparatus will deteriorate and thus, it will be difficult to provide an image display apparatus having high resolution.

In an image display apparatus of this embodiment, a deviated position memory and a correction system are provided. The deviated position memory stores data of deviation of landing position of electron beams on a fluorescent layer. The correction system applies an off-set voltage between a pair of electrodes sandwiching electron beams to correct the deviation of landing positions of electron beams based on the stored data. According to the image display apparatus, even if the deviation of landing position of electron beams on a fluorescent layer is generated by an error in assembling an image display apparatus, the deviation can be corrected by applying an offset voltage to each electrode. Consequently, error irradiation caused by the deviation of landing positions of electron beams can be prevented. As a result, a display having high resolution can be provided.

According to the respective electrodes of the image display apparatuses in the embodiments, the pairs of electrodes sandwiching the electron beams can be divided and all electrodes can be arranged independently. Alternately pairs of electrodes can be divided into a plurality of blocks corresponding to the blocks of the respective electron beams. In such a structure, various potential difference (off-set voltage) can be provided independently to every electron beam or to the electron beams divided into the blocks.

In the structure, when the landing positions of the electron beams are deviated variously because of the errors in manufacturing an image display apparatus, an off-set voltage can be applied independently to every electron beam or to electron beams divided into blocks. As a result, the deviation of the landing position of every electron beam or the electron beams divided into blocks can be corrected independently and efficiently.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. An image display device comprising, in a vacuum container whose interior is kept under vacuum:

a fluorescent layer;

an electron emission source having an electron source; and electrodes to control electron beams emitted from the electron emission source, wherein the electron beams illuminate the fluorescent layer, and one of the electrodes, which is arranged between the fluorescent layer and the electron emission source and functions to deflect the electron beams, comprises a first plurality of wires, a second plurality of wires and a frame of a resilient material, the frame comprising two opposing sides, the two sides being flat plates that are arranged to be substantially parallel to the fluorescent layer;

the first plurality of wires is strung with a certain tensile force on the flat plates by using resilience of the flat plates so as to be included in one surface substantially parallel to the fluorescent layer, the second plurality of wires is strung with a certain tensile force on the flat plates by using resilience of the flat plates so as to be included in one surface substantially parallel to the fluorescent layer, the first plurality of wires and the second plurality of wires are parallel to each other, the first plurality of wires is applied with a first potential while the second plurality of wires is applied with a second potential different from the first potential in order to deflect the electron beams passing between the first wires and the second wires in a predetermined direction according to a difference between the first potential and the second potential so that the electron beams land at desired positions on the fluorescent layer.

2. The image display apparatus according to claim 1, wherein the electron source is divided in a matrix.

3. The image display apparatus according to claim 1, wherein the electron source is divided in stripes.

4. The image display apparatus according to claim 1, wherein the electron source is continuously arranged on a plane.

5. An image display apparatus comprising, in a vacuum container whose interior is kept under vacuum:

a fluorescent layer;

an electron emission source having an electron source; and electrodes to control electron beams emitted from the electron emission source, wherein the electron beams illuminate the fluorescent layer, and at least one of the electrodes is formed by stringing wires on a frame of resilient material, the frame comprising two opposing sides on which the wires are strung, the two sides being flat plates that are formed on one surface, the electrode is arranged between the fluorescent layer and the electron emission source, and the difference between the coefficient of thermal expansion of the components where the fluorescent layer is formed and that of the frame is less than or equal to $8\times10^{-7}/°$ C. in a temperature range from 0 to 150° C.

6. An image display apparatus comprising, in a vacuum container whose interior is kept under vacuum:

a fluorescent layer;

an electron emission source having an electron source; and electrodes to control electron beams emitted from the electron emission source, wherein the electron beams illuminate the fluorescent layer, and at least one of the electrodes is formed by stringing wires on a frame of resilient material, the frame comprising two opposing sides on which the wires are strung, the two sides being flat plates that are formed on one surface, the frame is formed by using a first frame member, a second frame member and an insulating layer, the first frame member and the second frame member are adhered to each other via the insulating layer, the wires are strung on the surfaces of the first frame member and of the second frame member not contacting with the insulating layer, and the electrode is arranged between the fluorescent layer and the electron emission source.

7. An image display apparatus comprising, in a vacuum container whose interior is kept under vacuum:

a fluorescent layer;

an electron emission source having an electron source; and electrodes to control electron beams emitted from the electron emission source, wherein the electron beams illuminate the fluorescent layer, and at least one of the electrodes is formed by stringing wires on a frame of resilient material, the frame comprising two opposing sides on which the wires are strung, the two sides being flat plates that are formed on one surface the opposing two sides of the frame to which the wires are fixed are made of metal, insulating films are applied to the surfaces of the opposing sides, conductive parts are patterned on the insulating films, the wires are strung to conduct with the conductive parts, and the electrode is arranged between the fluorescent layer and the electron emission source.

8. The image display apparatus according to claim 7, wherein the insulating films are formed by using a thermally-sprayed alumina layer and glass frit, and the conductive parts are formed by using silver paste.

9. The image display apparatus according to claim 1, wherein the fluorescent layer is applied to the inner surface of the vacuum container.

10. An image display apparatus according to claims 5, wherein the electron source is divided into a matrix.

11. An image display apparatus according to claims 5, wherein the electron source is divided into stripes.

12. An image display apparatus according to claims 5, wherein the electron source is continuously arranged on a plane.

13. An image display apparatus according to claims 5, wherein the fluorescent layer is applied to the inner surface of the vacuum container.

14. An image display apparatus according to claims 6, wherein the electron source is divided into a matrix.

15. An image display apparatus according to claims 6, wherein the electron source is divided into stripes.

16. An image display apparatus according to claims 6, wherein the electron source is continuously arranged on a plane.

17. An image display apparatus according to claims 6, wherein the fluorescent layer is applied to the inner surface of the vacuum container.

18. An image display apparatus according to claims 7, wherein the electron source is divided into a matrix.

19. An image display apparatus according to claims 7, wherein the electron source is divided into stripes.

20. An image display apparatus according to claims 7, wherein the electron source is continuously arranged on a plane.

21. An image display apparatus according to claims 7, wherein the fluorescent layer is applied to the inner surface of the vacuum container.

22. An image display device comprising, in a vacuum container whose interior is kept under vacuum:

a fluorescent layer;

an electron emission source having an electron source; and electrodes to control electron beams emitted from the electron emission source, wherein the electron beams illuminate the fluorescent layer, and at least one of the electrodes is arranged between the fluorescent layer applied to an inner surface of the vacuum container and the electron emission source and is formed by stringing wires on a frame having only one vacancy at the center part and having only four sides, the frame is made of a resilient material, and the wires are strung on two opposing sides of the frame, the two sides being flat plates that are formed on one surface.

23. An image display device comprising, in a vacuum container whose interior is kept under vacuum:

a fluorescent layer;

an electron emission source having an electron source; and electrodes to control electron beams emitted from the electron emission source, wherein the electron beams illuminate the fluorescent layer applied to an inner surface of the vacuum container, and at least one of the electrodes is arranged between the fluorescent layer and the electron emission source and is formed by stringing wires on a frame having only one vacancy at the center part and having only four sides, the frame is made of a resilient material, and the wires are strung on two opposing sides of the frame, the two sides being flat plates that are formed on one surface;

wherein the electron source is divided into a matrix.

24. An image display device comprising, in a vacuum container whose interior is kept under vacuum:

a fluorescent layer;

an electron emission source having an electron source; and electrodes to control electron beams emitted from the electron emission source, wherein the electron beams illuminate the fluorescent layer applied to an inner surface of the vacuum container, and at least one of the electrodes is arranged between the fluorescent layer and the electron emission source and is formed by stringing wires on a frame having only one vacancy at the center part and having only four sides, the frame is made of a resilient material, and the wires are strung on two opposing sides of the frame, the two sides being flat plates that are formed on one surface;

wherein the electron source is divided into stripes.

25. An image display device comprising, in a vacuum container whose interior is kept under vacuum:

a fluorescent layer;

an electron emission source having an electron source; and electrodes to control electron beams emitted from the electron emission source, wherein the electron beams illuminate the fluorescent layer applied to an inner surface of the vacuum container, and at least one of the electrodes is arranged between the fluorescent layer and the electron emission source and is formed by stringing wires on a frame having only one vacancy at the center part and having only four sides, the frame is made of a resilient material, and the wires are strung on two opposing sides of the frame, the two sides being flat plates that are formed on one surface;

wherein the electron source is continuously arranged in a plane.

* * * * *